United States Patent [19]

Jacobsson

[11] 4,235,388

[45] Nov. 25, 1980

[54] THREAD STORAGE AND DELIVERY DEVICE

[75] Inventor: Kurt A. G. Jacobsson, Ulricehamn, Sweden

[73] Assignee: Aktiebolaget IRO, Ulriceham, Sweden

[21] Appl. No.: 73,852

[22] Filed: Sep. 10, 1979

[30] Foreign Application Priority Data

Sep. 11, 1978 [DE] Fed. Rep. of Germany ..... 2839437

[51] Int. Cl.[3] ..... B65H 51/20

[52] U.S. Cl. ..... 242/47.01; 242/47.12

[58] Field of Search ..... 242/47.01, 47.12, 47.13, 242/47.04, 47.05, 82, 83; 66/132 R; 139/452

[56] References Cited

U.S. PATENT DOCUMENTS

| | | | |
|---|---|---|---|
| 3,720,384 | 3/1973 | Rosen | 242/47.01 |
| 3,737,112 | 6/1973 | Tellerman et al. | 242/47.01 |
| 3,776,480 | 12/1973 | Lawson | 242/47.01 |
| 3,791,598 | 2/1974 | Vischiani et al. | 242/47.12 |
| 3,796,384 | 3/1974 | Rosen | 242/47.12 |
| 3,944,156 | 3/1976 | Jacobsson et al. | 242/47.12 |
| 4,090,677 | 5/1978 | Savio et al. | 242/47.01 |
| 4,092,006 | 5/1978 | Jacobsson | 242/47.01 |

*Primary Examiner*—Stanley N. Gilreath
*Attorney, Agent, or Firm*—James E. Nilles

[57] ABSTRACT

A thread storage and delivery device comprises a storage drum journalled by bearings on a driven axle.

A retaining sleeve is journalled in eccentric inclined bearings at a stationary support of the device and the storage drum respectively. The sleeve is drivingly engaged by a radial arm extending from and fixed to the axle. The driven radial arm winds on the thread coming from a thread supply cone onto the surface of the storage drum.

Rotation of the storage drum is prevented by the inclined, eccentric journalling of the sleeve between the stationary support of the device and the storage drum.

The sliding movement between the driven radial arm and the sleeve is minimized by the fact that the axis of the sleeve intersect the center axis of the device at a point which is located approximately in a region delineated by notional planes drawn radially to the center axis through the points of driving contact between the radial arm and the sleeve during a complete revolution of the driven axle.

4 Claims, 1 Drawing Figure

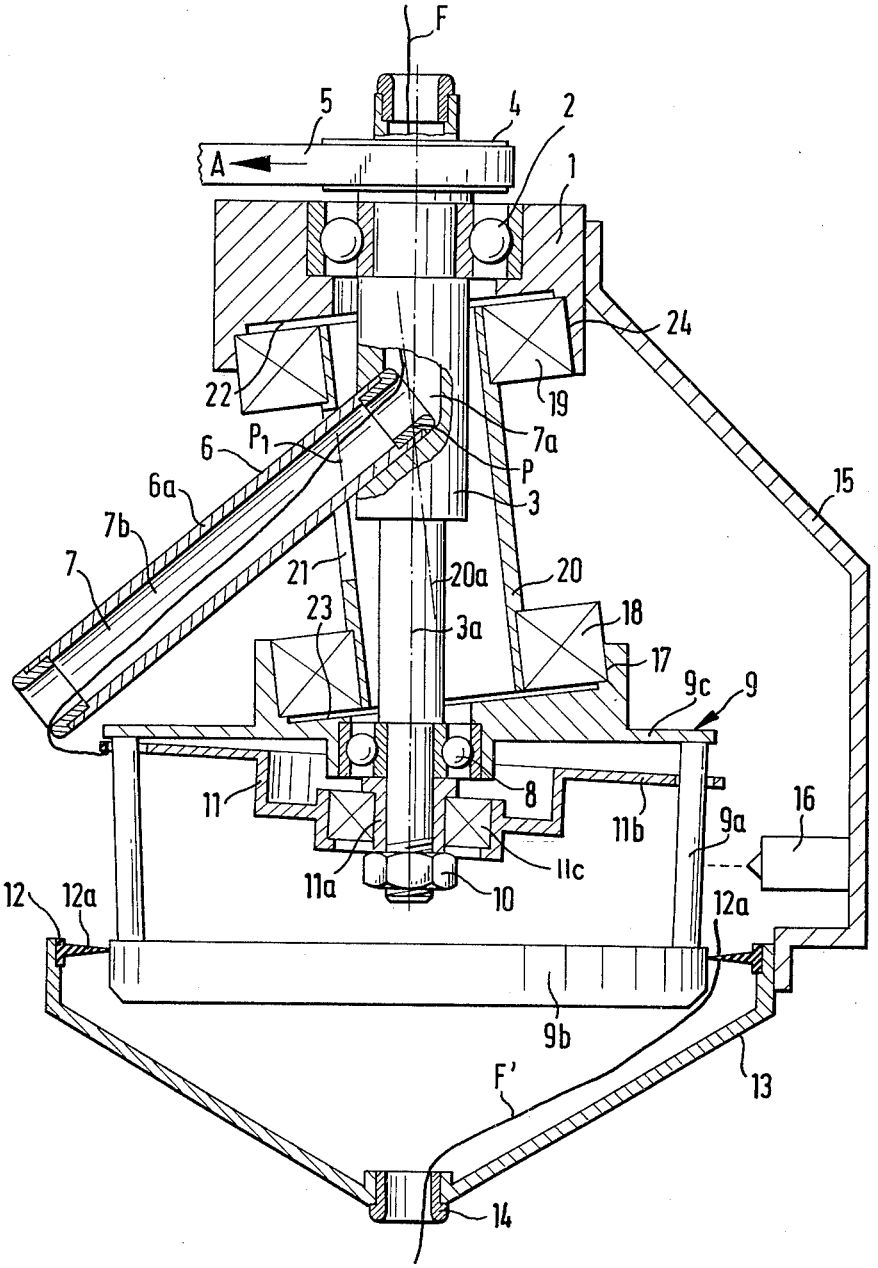
F
5
4
2
A
1
24
22
19
7a
6
P1
P
6a
3
15
7b
7
21
20a
20
23
3a
18
17
9c
9
11
8
11b
16
9a
11c
11a
10
12
12a
12a
9b
F'
13
14

THREAD STORAGE AND DELIVERY DEVICE

The invention relates to a thread storage and delivery device comprising a storage drum supported at the free end of an axle rotatably journalled in a fixed support member, a thread supply device driveable by the axle to wind the thread in turns onto the storage drum, and a tubular retaining element eccentrically surrounding the axle between its bearing on the support member and the storage drum, the retaining element being rotatable with the thread supply device and journalled on the support member and on the storage drum respectively, and serving to lock the storage drum against rotation, and wherein the thread supply device has at least one hollow radial arm projecting through an opening in the retaining element.

This type of device is known from German Offenlegungsschrift No. 27 55 821. The retaining element is mounted with a considerable eccentricity with respect to the axle between the support member and the storage drum. The radial arm is arranged so that it extends at an angle towards the storage drum and penetrates the opening in the retaining element with a considerable degree of play. Because of the construction there is large relative movement between the radial arm and the opening when the radial arm entrains and thereby imposes its rotary movement on the retaining element. The locus of the point of contact between the radial arm and the retaining element not only slides to a considerable radial extent inwardly and outwardly relative to the axle but also upwardly and downwardly parallel to the axle in consequence of the inclination of the radial arm in the opening. Despite the roller mounting of the retaining element it has a distinct resistance to rotation so that in the region of contact between the radial arm and the inside of the opening considerable cyclical frictional forces arise. These forces result in an exceptionally high wear and an additional imbalance in the device which is undesirable, especially in the case of delicate thread material.

A further thread storage and delivery device is known from German Pat. No. 23 43 994. The axle is connected at one end to the storage drum so that it cannot be rotated. The other end penetrates a support member of the thread supply device. The end projecting beyond the support member is cranked and forms an axially parallel eccentric bearing pin. The support member is driveably journalled in a fixed casing. A disc is pivotable about the bearing pin of the axle as a retaining element and is rotatably mounted at its outer edge in a fixed casing. A tubular coupling pin is mounted parallel with the axle and spaced therefrom in the support member and projecting on both sides such that one end of it extends to the region of the storage drum while its other end penetrates a radial slit in the disc, which serves as the retaining element. The inside of the coupling pin serves as a channel for the thread to be supplied. When the support body of the thread supply device is rotated then the thread passing out of the thread channel is wound onto the drum while the other end of the coupling pin entrains the disc. Entrainment of the axle and thus of the storage drum arranged thereon so as to be fixed with respect to rotation is prevented by the mounting of the disc on the bearing pin which is eccentric of the bearing between the support body and the axle. The arrangement does however, require a large number of rotary bearings of which the casing bearings of the support member and of the disc must have a large diameter and therefore are expensive. The device is relatively large and overhanging perpendicular to its axis and also to the longitudinal direction.

A thread delivery and storage device known from German Auslegeschrift No. 20 37 031 has the same disadvantageous space requirement. In construction it is even more expensive since on the one hand it has a coupling pin on the support member of the thread device which entrains the disc shaped retaining element, and also has a thread channel independent thereof and separately arranged. The thread which is to be supplied arrives in this channel through a recess in the disc which forms the retaining element, and the said disc must be particularly carefully constructed in order to ensure safe thread supply. The thread passes out of the thread channel of the support body through an inclined channel borehole in the sleeve wall and arrives at the drum via an eyelet arranged in the region of the support body which extends up as far as the drum. This arrangement is also disadvantageous because of the exit and re-entry of the thread into the guide elements and because of the construction height of the support body which is necessary.

The present invention aims at the provision of a device of the general form first described in which the storage drum is secured against rotation in a compact manner, and which exhibits a minimal amount of imbalance, small maintenance requirements and low wear in operation.

In accordance with the invention there is provided a thread storage and delivery device comprising a storage drum supported at the free end of an axle rotatably journalled in a fixed support member, a thread supply device driveable by the axle to wind the thread in turns onto the storage drum, and a tubular retaining element eccentrically surrounding the axle between its bearing on the support member and the storage drum, the retaining element being rotatable with the thread supply device and journalled on the support member and on the storage drum respectively and serving to lock the storage drum against rotation, and wherein the thread supply device has at least one hollow radial arm projecting through an opening in the retaining element and wherein the axis of rotation of the retaining element is inclined with respect to the centre axis of the axle and intersects this centre axis at a point which is located approximately in the region delineated by planes drawn radially to the centre axis through the points of contact between the radial arm and the retaining element in a complete revolution of the axle.

The device constructed in this way does not require very much space in an axial direction or transverse thereto since the retaining element arranged between the casing and the drum is accommodated in space which is present in any case substantially within the path of the thread to the drum. The inclined position of the retaining element and the special arrangement of the point of intersection of the respective axes of rotation eliminates to a large extent the radial relative movement between the radial arm and the inside of the opening. The movement of the point of contact which takes place longitudinally of the retaining element is restricted to a tolerable extent. In this region there is hardly any wear due to friction. Since the point of contact between the radial arm and the retaining element describes a path which is only slightly elliptical, the resultant imbalance is also negligible. The storage drum however is kept perfectly still so that the thread is treated in a particularly gentle way and the result is operation which is particularly low in noise and free of vibration. The retaining element is readily designed as a simply manufactured and assembled component which can have a narrow wall thickness and a high resistance to deformation while having a small mass.

Further details and advantages of the invention are apparent from the following description of one embodiment thereof, which is shown in the drawings in longitudinal section. The longitudinal axis of the device is vertical in the drawings although the position of the device in use is usually horizontal and in fact is such that the thread is wound on from a thread cone on the drive side of the device and is removed, i.e. drawn off on the other side of the device to the machine, in this case a weaving machine.

The thread storage and delivery device has a fixed support member 1 indicated schematically. An axle 3 is rotatably journalled about its longitudinal axis 3*a* with the aid of a bearing 2 in the support member 1. At the end projecting beyond the support member 1, the axle carries a drive wheel 4 by means of which it may be driven in the direction of arrow A via a drive belt 5, by a motor (not shown).

The axle 3 is rigidly connected to a radial arm 6*A* of a thread supply device designated 6 overall, approximately in its centre region, the said radial arm being set at a spacing and an angle towards the outer periphery of a storage drum designated 9. The axle 3 is hollow up to the extension of the arm 6*a*. Its hollow space 7*a* together with the hollow space 7*b* of the tubular arm 6*a* forms a thread channel 7 of the thread supply device through which there runs a thread F.

The storage drum 9 is rotatably mounted on the end region of the axle 3 remote from the driven end by means of a ball bearing 8. The hub 11*a* of a wobble disc 11 is mounted between the ball bearing 8 and a nut 10 screwed onto the end of the axle 3, so that the hub rotates with the axle. The external cylindrical surface of the hub 11*a* has its axis oblique to that of the axle, and a bearing 11*c* is interposed between that surface and the wobble disc 11 itself. The wobble disc has spokes 11*b* which extend through and beyond rods 9*a*, that comprise the storage drum. The base region 9*b* of the storage drum, which is remote from the axle 3 is surrounded by a yarn braking ring 12 which is mounted on a covering hood 13 and has resilient fingers 12*a* lightly engaging the rim of the storage drum. The covering hood 13 supports at its centre a draw off eye-let 14 for the thread F′ which is drawn off from the storage drum. This draw off eyelet is in alignment with the centre axis 3*a*. The covering hood 13 is mounted on a support arm 15 which is fixed in turn to the support member 1. Support arm 15 also supports a photo-electric device 16 for monitoring the thread supply on the surface of the storage drum 9.

The storage drum 9 has an inclined housing 23 with a recess 17 on its covering surface 9*c* which is remote from the base region 9*b*, said housing 23 and recess 17 being arranged to encircle the centre axis 3*a*, but eccentric relative thereto. A ball bearing 18 is mounted in the recess 17. An inclined housing 22 having a recess 24 is also provided eccentrically in the covering part of the support member 1. The housings 23, 22 and the recesses 21, 17 lie in parallel to each other and support the respective bearings 18, 19 for a sleeve 20, which constitutes a retaining element for the storage drum, i.e. an element which will prevent the storage drum from rotating with the driven axle when the thread is wound onto the drum by means of the radial arm. The said sleeve 20 encircles the axle 3 and has a longitudinal slot 21 for the radial arm 6*a*. The sleeve 20 and its longitudinal axis 20*a* are thus inclined with respect to the centre axis 3*a*. The axes 20*a*, 3*a* intersect at a point P which lies on the centre axis 3*a* in a region in which the radial arm 6*a* is in contact with the longitudinal slot 21 throughout 360° of revolution. This region indicated as $P_1$—as projected radially onto the centre axis 3*a*—delimits the position of the point of interestion P. Suitably, the point P is selected at the centre of this region.

In other words the position of point P is delineated by notional planes perp-endicular to the centre axis 3*a* and through the locus of the point of driving contact between the radial arm and the sleeve 20. This locus has a relative small axial extent parallel with the axis 20*a* and is only slightly elliptical about the axis of rotation 3*a*.

In this way, the relative movements of the point of contact in the region $P_1$ is kept very small and moreover an only slightly elliptical path of the point of contact is achieved.

The retaining element 20 locks the storage drum 9 against rotation as follows: the axle 3 is driven for the purpose of supplying the thread. The radial arm 6*a* of the thread supply device 6 also joins in the rotary movement about axis 3, with its free end slightly below the covering surface 9*c* of the storage drum. During the rotary movements the arm 6*a* entrains the sleeve 20 through its engagement with one inside face of the longitudinal slit 21 so that the sleeve rotates about its axis 20*a*. Since the drum 9 is supported on the eccentric bearings 18 of the sleeve 20, it cannot rotate about its axle bearing 8.

The thread F is supplied through the thread channel 7 onto the surface of the stationary storage drum and is placed thereon in turns by means of rotary movement of the arm 6, these turns being displaced on the drum by the wobble disc 11, which is locked against rotation by its spokes interengaging the rods of the drum, but which is caused to wobble about the axle because of its hub 11*a* being inclined relative to the axis 3*a*. The thread F′ is drawn off from the region of the storage drum close to the base surface through the yarn braking ring 12 and the draw-off eyelet 14.

The invention is not restricted to the illustrated embodiment. Thus, within the framework of the concept of the invention, both the storage drum and the wobble disc and the support member may have considerable constructional differences. The shape and inclination of the radial arm of the thread supply device may also be modified.

I claim:

1. A thread storage and delivery device comprising a rotatably driven axle having a hollow end portion that is rotatably journalled in a fixed support member, a storage drum supported at the opposite end of the axle, and a hollow arm that projects radially outwardly from the axle at an inclination in the direction towards said opposite end thereof to have its outer end orbit the storage drum in consequence of axle rotation, the interior of said arm being communicated with the interior of said hollow portion of the axle so that thread can be drawn into said one end of the axle to be wound about the storage drum by said arm, said device being characterized by:

a retaining element whereby the storage drum is locked against rotation with the axle, said retaining element A. being in surrounding relation to the axle, B. having opposite end portions respectively so connected to said support member and to the storage drum that the retaining element is rotatable about its axis relative to them, C. having an opening which is elongated substantially parallel to its axis and through which said arm projects, said opening having edge portions slidingly engaged by said arm as the axle rotates to drive the retaining element for rotation about its axis, and D. having its axis inclined to and substantially intersecting the axis of said axle.

2. The thread storage and delivery device of claim 1, further characterized by:

the axis of said retaining element intersecting the axis of said axle at a point lying in a zone which is defined by planes normal to the axis of the axle and which contain the points of engagement of said arm with edge portions of said opening through a complete revolution of the axle.

3. The thread storage and delivery device of claim 1 wherein said retaining element is tubular and said opening is defined by an axially elongated slot therein.

4. The thread storage and delivery device of claim 1 wherein each of said support member and said storage drum has a bearing seat defined by a substantially circular recess which surrounds said axle and wherein a bearing ring for said retaining element is received, said bearing seats being arranged to dispose said bearing rings parallel with one another and coaxial with one another and the retaining element.

* * * * *